US012270631B2

(12) United States Patent
Bülow et al.

(10) Patent No.: US 12,270,631 B2
(45) Date of Patent: Apr. 8, 2025

(54) PERSONAL SECURITY DEVICE

(71) Applicant: MANUFACTURING COST CALCULATION (MCCAB) AKTIEBOLAG, Nämndemansgatan (SE)

(72) Inventors: Leif Bülow, Lund (SE); Richard Palmqvist, Svalöv (SE); Jonas Hellberg, Stockholm (SE)

(73) Assignee: MANUFACTURING COST CALCULATION (MCCAB) AKTIEBOLAG, Namndemansgatan (SE)

( * ) Notice: Subject to any disclaimer, the term of this patent is extended or adjusted under 35 U.S.C. 154(b) by 0 days.

(21) Appl. No.: 18/287,254

(22) PCT Filed: Apr. 19, 2021

(86) PCT No.: PCT/EP2021/060090
§ 371 (c)(1),
(2) Date: Oct. 17, 2023

(87) PCT Pub. No.: WO2022/058051
PCT Pub. Date: Mar. 24, 2022

(65) Prior Publication Data
US 2024/0200914 A1 Jun. 20, 2024

(51) Int. Cl.
*F41H 9/10* (2006.01)

(52) U.S. Cl.
CPC ..... *F41H 9/10* (2013.01)

(58) Field of Classification Search
CPC ..... F41H 9/10
See application file for complete search history.

(56) References Cited

U.S. PATENT DOCUMENTS 2,876,935 A * 3/1959 Lindberg ..... F41H 9/10 222/145.5
2,908,244 A * 10/1959 Clark ..... F41H 9/10 116/DIG. 44
3,228,565 A * 1/1966 Stanzel ..... F41H 9/10 222/83.5

(Continued)

FOREIGN PATENT DOCUMENTS

CN 206399299 U 8/2017
CN 208403996 U 1/2019

(Continued)

OTHER PUBLICATIONS

International Search Report & Written Opinion for Application No. PCT/EP2021/060090 mailed Dec. 21, 2021.

*Primary Examiner* — Joshua E Freeman
(74) *Attorney, Agent, or Firm* — MOSER TABOADA

(57) ABSTRACT

A personal security device (100), comprising: a base body (110) forming a chamber (110), wherein a first opening (140) of the chamber (110) is sealed by a film (190); a safety liquid provided in the chamber (110); and a cover body (200) movably attached to the base body (100). Wherein the cover body (200) comprises a first surrounding portion (210) circumscribing a first portion (180) of the base body (100), and a top portion (220) arranged above the film (190). Wherein the top portion (220) comprises a cutting device (230*a*, 230*b*) facing the film (190), and a release opening (240) extending through the top portion (220). Wherein the cover body (200) is configured to be moved in relation to the base body (100) such that the cutting device (230*a*, 230*b*) perforates the film (190) when the cover body (200) is moved towards the film (190) thereby releasing the safety liquid through the release opening (240).

12 Claims, 3 Drawing Sheets

(56) References Cited

U.S. PATENT DOCUMENTS 4,275,820 A * 6/1981 LeBlond ..... C06D 7/00 222/3
4,446,990 A * 5/1984 Stevenson ..... F41H 9/10 222/398
5,011,044 A * 4/1991 Brown ..... F41H 9/10 D22/117
5,088,624 A * 2/1992 Hackett ..... B65D 83/386 222/509
5,215,227 A * 6/1993 Farner ..... F41H 9/10 222/321.6
5,469,989 A * 11/1995 Graf ..... A61M 15/0025 222/327
5,897,026 A * 4/1999 Vester ..... F41H 9/10 222/83.5
6,367,473 B1 * 4/2002 Kafer ..... A61M 15/0041 128/203.19
10,096,221 B2 * 10/2018 Von Ehrenkrook . G08B 15/004
2005/0081419 A1 * 4/2005 Fleischhauer ..... F42B 12/40 42/1.08
2006/0081147 A1 * 4/2006 Walsh ..... F41H 9/10 102/368
2006/0117981 A1 * 6/2006 Williams ..... G08B 21/02 42/1.09
2009/0071459 A1 * 3/2009 Wenaas ..... F41B 11/62 124/71
2010/0186738 A1 7/2010 Kobayashi et al.
2021/0148678 A1 * 5/2021 Cox ..... G08B 15/02

FOREIGN PATENT DOCUMENTS

FR 743560 A 4/1933
FR 1260793 A 5/1961
JP 3226053 U 4/2020
KR 1020070021013 A 2/2007

* cited by examiner

PERSONAL SECURITY DEVICE

TECHNICAL FIELD

The present inventive concept generally relates to a personal security device.

BACKGROUND

The number of violent attacks, assaults and attempted assault over the world are getting an increased focus. Many of the attacks or assaults are unprovoked and happens when the victim is unprepared for anything to happen. This has caused a large feeling of unsafety and many people, especially women, who are not feeling safe being outside alone or in the dark.

For this, there are provided many different personal security devices. Such security devices often include sound, dyes or lighting to mark the offender and to alert the surroundings and in such a way interrupt the attack or assault.

However, the prior art has in common that it lacks the opportunity to easily connect the offender with the victim. Thereby an attack or assault may be hard to investigate. Moreover, it may be hard to convict anyone for the attack or assault since the only proof are often the words of the victim against the words of the offender.

SUMMARY

In view of the above, it is an object of the present invention is to provide an improved personal security device.

Another object is to provide such a personal safety device which is easy to use.

Another object is to provide such a personal safety device which provides a connection between the offender and the victim.

Another object is to provide such a personal safety device which is easy to manufacture.

Another object is to provide a cost-effective personal safety device.

To achieve at least one of the above objects and also other objects that will be evident from the following description, a personal safety device having the features defined in claim 1 is provided according to the present inventive concept. Preferred variations to the inventive concept will be evident from the dependent claims.

More specifically, according to an aspect there is provided a personal security device comprising a base body forming a chamber, wherein a first opening of the chamber is sealed by a film, a safety liquid provided in the chamber, and a cover body movably attached to the base body, wherein the cover body comprises a first surrounding portion circumscribing a first portion of the base body, and a top portion arranged above the film, wherein the top portion comprises a cutting device facing the film, and a release opening extending through the top portion, wherein the cover body is configured to be moved in relation to the base body such that the cutting device perforates the film when the cover body is moved towards the film thereby releasing the safety liquid through the release opening.

Within the framework of this application, a personal security device is understood to be a device adapted to, but not limited to, ward off an assault. The personal security device is adapted to be handled by using a single hand. By applying force to the top portion of the cover body, the cover body may be moved in relation to the base body such that the cutting device of the cover body perforates the film of the base body. By the perforation of the film, the safety liquid provided in the chamber of the base body is released through the release opening of the cover body. It is an advantage compared to the prior art that the device has a small size, such that it easily can be carried in a small bag, held concealed in the hand or be attached to the lining of the clothes.

The base body forms a chamber, which is sealed by a film. Thus, the chamber is provided with the safety liquid and sealed by the film such that the safety liquid is counteracted from leaving the base body before the perforation of the film.

By safety liquid it is meant a liquid which has properties that may be useful to defer or interrupt an assault and/or the liquid may be used to mark or provide with means for connecting the assault person to the victim. The liquid may have an odor, a color, it may cause itching or other skin irritation, it may have traceable additives such that it may be possible to connect the liquid to a person like an offender or assault person. An odor in the safety liquid may for instance smell so bad that the assault person may not be able to continue the assault. An odor or a color may mark the assault person such that it may be easy to identify and find the person.

By the wording circumscribing it is intended that the cover body surrounds the base body, such that the cover body acts as a protection around the base body. The cover body may surround the base body in different ways. The cover body may surround a portion of a height or longitudinal extension of the base body. The base body and the cover body may for instance be two cylinders, where the diameter of the cover body is larger than the diameter of the base body, such that the base body may be inserted into the cover body. The cover body may for instance cover the base body such that foreign sharp items may not reach and perforate the film.

By cutting device it is intended a device with a sharp end or a cutting edge, such as a pin or a knife or anything the like. The cutting device is mounted on the cover body, such that when the cover body is moved towards the film the cutting device is forced through the film, thus perforating the film. The cutting device may be made of plastic, metal or any other suitable material. The cutting device may be integrally formed with the cover body or may be formed as a separate part which is joined with the cover body. The perforation of the film allows for any liquid stored inside of the chamber to be released from the base body. The liquid will further run out of the release opening of the cover body. The release opening is extending through the top portion of the cover body. Thus, the release opening is provided such that it matches or corresponds the location of the first opening of the base body.

The chamber may comprise a first compartment and a second compartment. The second compartment may be surrounding the first compartment. The first compartment and the second compartment may each be two halves of the chamber. The first compartment and the second compartment may have different volumes. The safety liquid may comprise a first constituent of liquid and a second constituent of liquid. The first constituent of liquid may be provided in the first compartment and the second constituent of liquid may be provided in the second compartment. The first constituent of liquid and the second constituent of liquid may have different purposes. An advantage of using a first and a second compartment may be that the safety liquid may comprise a first constituent of liquid and a second constituent of liquid. The first and second constituent of liquid may be optimized in different ways. Such that they do not affect each other when the personal security device is stored before use. Thus, the composition of the first and the second constituent of liquid may each be optimized for different purposes without the influence of the other liquid.

The second constituent may comprise a marking substance. The marking substance may be one or more chosen from the group consisting of: an odor, a color and a fluorescent substance. The marking substance may comprise one or more constituents chosen from the group consisting of: skatol, 3-methylindole, triethyl phosphite, butyric acid, benzylthiol, benzyl mercaptan, 2-mercaptoethanol, 1,2-Ethanedithiol, trimethylphosphite, cadaverin, pentamethylenediamine, 2-Mercaptophenol, o-mercaptophenol, thiophenol, tiophene-2-thiol, 3-Mercaptophenol, 3-Hydroxythiophenol and bis(trimethylsilyl)sulfide. The marking substance may have the purpose of marking a person responsible for the assault, such that the person may easily be traced or tracked. For instance, the tracking may be performed by police dogs. The marking substance may be of a kind which is not easily removed when applied to for instance clothes or skin, making it hard for the assault person to get rid of the marking. The marking substance may be of a kind, for instance an odor, which may attract attention from the surroundings. The odor may for instance be an odor which smells extremely bad, making the assault person interrupt the assault by the smell of the odor.

The first constituent of liquid may comprise a traceable substance. The traceable substance may be one or more chosen from the group consisting of DNA, synthetic DNA, micro-identifier and dyes. The DNA may be acquired from the user. The synthetic DNA may be non-human DNA. The micro-identifier may be small sized dots made of for instance metal, which may have a unique identifying code or surface or pattern. Such that it may be possible to connect a personal security device with a traceable substance with a specific micro-identifier to an assault person if the first constituent of liquid was enabled to leave the first compartment and reach the assault person. Thus, the first constituent of liquid may be an identifiable liquid, which may be hard to wash away if it reaches the clothes, accessories, or skin of a person. Further, the first constituent may comprise a DNA-stabilizing agent. The DNA-stabilizing agent may be chosen from the group consisting of Tris-HCl in combination with EDTA and Tris-HCl in combination with EDTA-$Na_2$. The concentration of Tris-HCl may be 1, 2, 3, 4, 5, 6, 7, 8, 9, 10, 11, 12, 13, 14 or 15 mM. The concentration of EDTA or EDTA-$Na_2$ may be 0.1, 0.5, 1, 2, 3, 4 or 5 mM. The pH may vary from 7.5-9. The traceable substance may have the purpose of connecting the assault person to the victim. Thus, using the traceable substance it may be possible to connect the assault person with a specific personal security device and hence with a specific victim.

The base body may further comprise a second opening. The second opening may be provided with a resealable lid such that the second opening enables addition of a traceable additive to the first constituent of liquid. The traceable additive may comprise one or more chosen from the group consisting of: DNA, synthetic DNA and micro-identifier. The traceable additive may be the DNA of the user, which may be added through the second opening. The synthetic DNA may be non-human DNA. The micro-identifier may be small sized dots of for instance metal, which may have a unique identifying code or surface or pattern. Thus, the first compartment may be provided with a DNA-stabilizing agent and may further be complemented with the DNA of the user. The user may by itself collect DNA from for instance their mouth, using a specified equipment. The user may for instance collect DNA from their mouth using a swab or a peg. The DNA may be added through the second opening to the first compartment, where it reaches the DNA-stabilizing agent. For instance, the user may use the swab or the peg to introduce the collected DNA to the DNA-stabilizing agent, using the second opening. In such a variant, the safety liquid of the personal security device is consequently uniquely connected to the specific person by its DNA. Thus, the assault person may be connected to the victim by the DNA of the victim if the victim exposes the assault person to the safety liquid of the personal security device.

Upon an attempt to an assault or an assault, the victim may apply force to the top portion of the cover body. The force may be applied by for instance holding the device in one hand or by pressing the device towards the body of the assault person. The force may thus move the cover body in relation to the base body, such that the cutting device is perforating the film. When the film is perforated, the safety liquid will run out of the device through the release opening. The safety liquid may then be forced upon the assault person. By comprising a first constituent of liquid and a second constituent of liquid, for instance a traceable substance and a marking substance respectively, the assault person may be marked visually or by a smell as well as a traceable substance. If the marking substance is an odor, the odor may be of a kind which deters the assault person from continuing the assault. Thus, the assault person may find the odor to be so deterring that the person finds it impossible to pursue the assault. The assault person may for instance start vomiting when exposed to the odor. In combination, the odor may mark the assault person such that it may be easy for a police dog to identify the location of the assault person. Further, it the first constituent of liquid comprises a DNA-stabilizing agent in combination with DNA from the victim (added beforehand) it may connect the assault person to the victim. Moreover, I the first constituent of liquid comprises synthetic DNA or micro-identifier it may connect the assault person to the specific personal security device. This may increase the chance of the police finding the assault person and connecting the assault person to the assault or crime.

It is an advantage of the personal security device that it may be possible to personalize it by the user. Thus, to connect the specific device with a person, there is no need for keeping records of general or specific identification markers.

Further, it is an advantage of the present personal security device that the marking substance may be an odor which may deter the assault. Thus, it may decrease the amount of completed assaults.

The device may further comprise a removable lock body. The lock body may comprise a second surrounding portion at least partially circumscribing a second portion of the base body. The lock body may further comprise a handle portion. The handle portion may extend from the second surrounding portion. The lock body may be arranged such that the movement of the cover body towards the film is restricted. Thus, when arranged around a second portion of the base body the lock body may restrict any force to move the cover body in relation to the base body and thus the cutting device from perforating the film. This may be an advantage since it may allow the device to be stored even in small spaces such as bags or pockets without the risk of perforating the film without a purpose to do so.

It is an advantage of the present device that it may be small in size. The small size may allow for even a person with small hands, such as a child, to use it. It further allows it to be kept in small spaces and to be easily carried at any time.

Further, the handle portion of the lock body may provide a handle to easily, and using only one hand, remove the lock body. Further, the handle may be provided with means for hanging the device on the lining of clothes, on bags or to attach a string to wear it around the neck or in a keychain for instance. In combination with the small size of the device, this provides an easy handling and storage of the device at any time.

It is an advantage of the present invention that the user may not need to carry a bag or anything the like to be able to keep the device close.

The base body and the cover body may further comprise a cooperating holding arrangement configured to restrict movement of the cover body towards the film. The holding arrangement may be releasably engageable. The cooperating holding arrangement may consequently put a larger demand on the force needed to move the cover body in relation to the base body. Thus, if no lock body is present the holding arrangement counteracts the cover body from falling towards the base body and thus hinders the perforation of the film. This may further provide a safety aspect where any unintentional perforation may be avoided. The holding arrangement may be provided such that upon force to the cover body, the cooperating holding arrangement is released from each other making it possible to use the device as intended and perforate the film.

The base body and the cover body may further comprise a further cooperating holding arrangement configured to restrict movement of the cover body away from the film. Thus, there may be a further holding arrangement which counteracts the cover body from unintentionally fall of the base body. If the cover body falls of the base body, the cutting device is no longer in reach of the film. Thus, perforating the film is no longer possible in the intended way.

BRIEF DESCRIPTION OF THE DRAWINGS

The above, as well as additional objects, features and advantages of the present inventive concept, will be better understood through the following illustrative and non-limiting detailed description, with reference to the appended drawings. In the drawings like reference numerals will be used for like elements unless stated otherwise.

DETAILED DESCRIPTION

Figure 1:
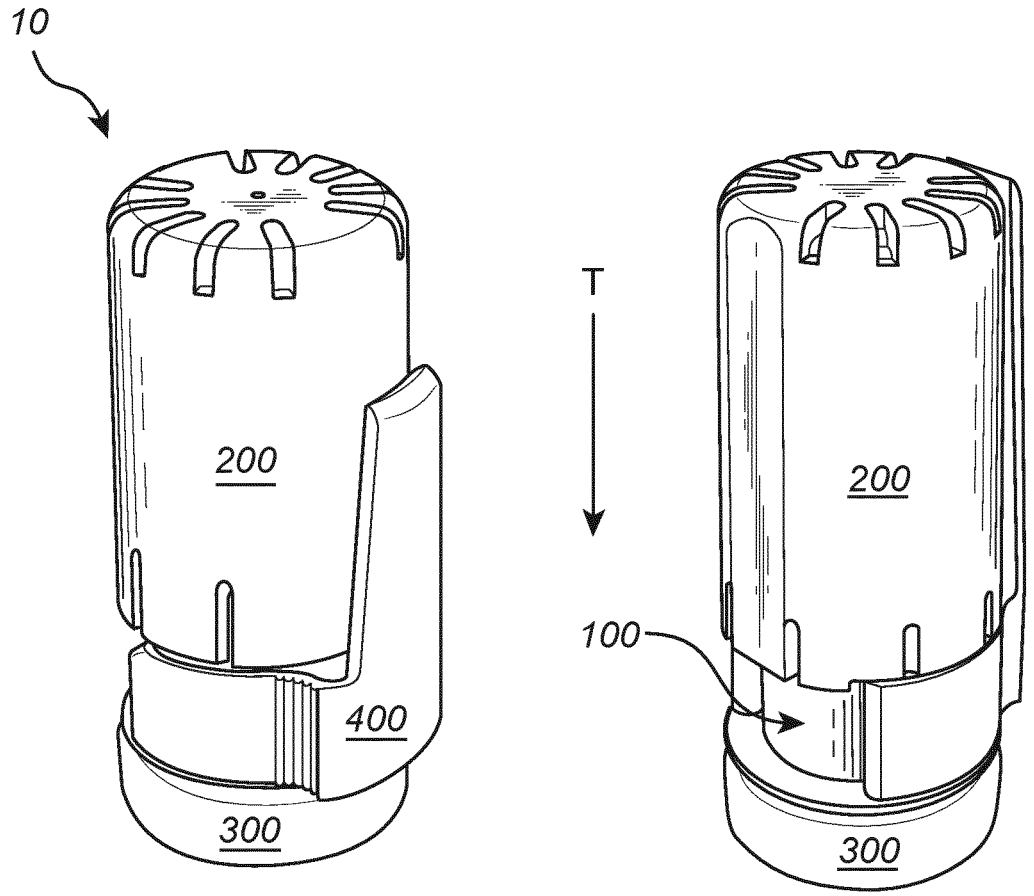
FIG. 1 conceptually illustrates two different perspective side views of one and the same personal security device.

The present inventive concept will now be described more fully hereinafter with reference to the accompanying drawings, in which currently preferred variants of the inventive concept are shown. This inventive concept may, however, be embodied in many different forms and should not be construed as limited to the variants set forth herein; rather, these variants are provided for thoroughness and completeness, and fully convey the scope of the inventive concept to the skilled person.

Now referring to the figures, the present inventive concept relates to a personal security device 10 comprising a base body 100 forming a chamber 110, wherein a first opening 140 of the chamber is sealed by a film 190, a safety liquid provided in the chamber 110 and a cover body 200 movably attached to the base body 100, wherein the cover body 200 comprises a first surrounding portion 210 circumscribing a first portion of the base body 180, and a top portion 220 arranged above the film 190, wherein the top portion 220 comprises a cutting device 230*a*, 230*b* facing the film 190, and a release opening 240 extending through the top portion 220, wherein the cover body 200 is configured to be moved in relation to the base body 100 such that the cutting device 230*a*, 230*b* perforates the film 190 when the cover body 200 is moved towards the film 190 thereby releasing the safety liquid through the release opening 240.

From the figures and description, it will be appreciated that the first surrounding portion 210 of the cover body 200 circumscribes the first portion 180 of the base body 100, such that the cover body 200 surrounds and covers the base body 100.

Upon an attempted assault, the user may press the cover body 200 towards T the base body 100 such that the top portion 220 of the cover body 200 moves towards the film 190. This movement of the cover body 200 towards the film 190 is indicated by the arrow T in FIG. 1. The cutting device 230*a*, 230*b* may then perforate the film 190, enabling the safety liquid to run out of the chamber 100 and through the release opening 240. The safety liquid may be collected in the hand of the user and forced on to the assault person. The safety liquid may run out immediately on the assault person of the top of the cover body are pressed towards the assault person.

The safety liquid may cause the assault person discomfort by comprising an odor, by being a sharp dye, by being a fluorescent compound or any combination thereof. For instance, if the safety liquid comprises an odor the odor may have such a bad smell that it forces the assault person away. Further, the smell, color and/or fluorescent compound may mark the assault person such that the assault person may be identified by security personal or the police, or such that the surrounding persons may identify the person as being marked.

Now referring to FIG. 1 in particular. Here is shown a side view of a personal security device 10 comprising a base body 100, a cover body 200, a resealable lid 300 and a lock body 400. The relation between the different components will be discussed further in relation to the FIGS. 2-5.

The base body 100, the cover body 200 and the lock body 400 may be molded from plastic. The base body 100, the cover body 200 and the lock body 400 may however be made of different materials using different manufacturing techniques. The base body 100, the cover body 200 and the lock body 400 may for instance be made of metal. The base body 100, the cover body 200 and the lock body 400 may be made of different materials.

The resealable lid 300 may be molded from rubber, silicone, plastic or the like. The resealable lid 300 may be flexible which improves the sealing capabilities of the resealable lid 300.

Figure 2A:
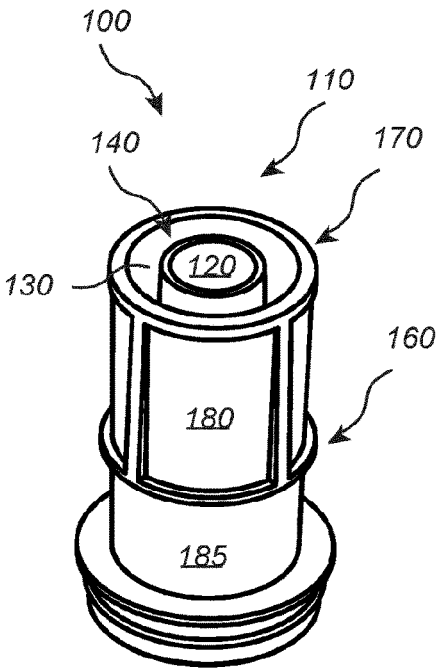
FIG. 2*a* conceptually illustrates a perspective side view of the base body.
Figure 2B:
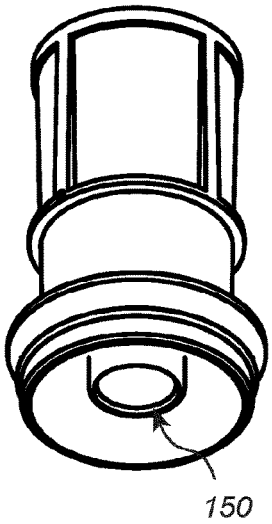
FIG. 2*b* conceptually illustrates a different perspective side view of the base body of FIG. 2*a*.
Figure 2C:
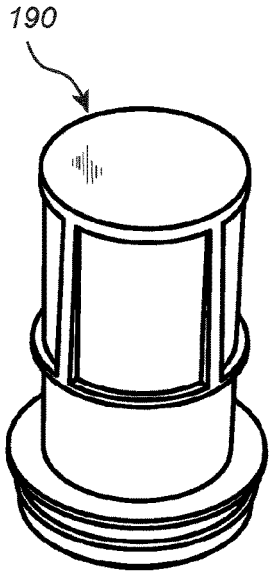
FIG. 2*c* conceptually illustrate a perspective side view of the base body of FIGS. 2*a* and 2*b* covered by a film.

FIGS. 2*a* and 2*b* show side views of the base body 100 of the personal security device 10. FIG. 2*c* shows a side view of the base body 100 covered by a film 190. The depicted base body 100 is forming a chamber 110, which comprises a first compartment 120 and a second compartment 130. The base body 100 may have a single chamber 110 having a single compartment. The first compartment 120 is arranged such that it is enclosed in the volume of the second compartment 130. The first compartment 120 and the second compartment 130 has the same height. The chamber 110 has a first opening 140 which is suitable to be sealed by a film 190. The film 190 may be a sheet made of metal, plastic, paper or a combination thereof. The film 190 is adapted to be perforated. The first opening 140 is an opening for the first compartment 120 and the second compartment 130. Further, the base body 100 comprises a second opening 150. The second opening 150 is an alternative opening of the first compartment 120. Thus, the second compartment 130 may have a sealed bottom, while the first compartment 120 may have two open ends when the base body is viewed in isolation, i.e. without the film 190 and the resealable lid 300.

The depicted first compartment 120 and the second compartment 130 of FIGS. 2*a* and 2*b* are adapted to provide space for a safety liquid. If the base body 100 has a single chamber 110, the single chamber 110 is adapted to provide space for a safety liquid. The safety liquid may comprise a first constituent of liquid and a second constituent of liquid. The first and the second constituent of liquid may be mixed and provided in the single chamber 110. The first constituent of liquid may be provided in the first compartment 120 and the second constituent of liquid may be provided in the second compartment 130. The first constituent of liquid may comprise a DNA-stabilizing agent. The DNA-stabilizing agent may be chosen from the group consisting of Tris-HCl in combination with EDTA or Tris-HCl in combination with EDTA-$Na_2$. The concentration of Tris-HCl may be 2, 3, 4, 5, 6, 7, 8, 9, 10, 11, 12, 13, 14 or 15 mM. The concentration of EDTA or EDTA-$Na_2$ may be 0.5, 1, 2, 3, 4 or 5 mM. The pH may vary from 7.5-9. Using the second opening 150, an additive may be provided to the first constituent of liquid. The additive may be provided by the user. The first constituent of liquid may comprise a traceable substance. The second constituent of liquid may comprise a marking substance.

The marking substance may be one or more chosen from the group consisting of: an odor, a color and a fluorescent substance. Further, the marking substance may comprise one or more chosen from the group consisting of: skatol, 3-methylindole, triethyl phosphite, butyric acid, benzylthiol, benzyl mercaptan, 2-mercaptoethanol, 1,2-Ethanedithiol, trimethylphosphite, cadaverin, pentamethylenediamine, 2-Mercaptophenol, o-mercaptophenol, thiophenol, tiophene-2-thiol, 3-Mercaptophenol, 3-Hydroxythiophenol and bis(trimethylsilyl) sulfide.

The traceable additive may comprise one or more chosen from the group consisting of: DNA, synthetic DNA and micro-identifier. The traceable substance may be one or more chosen from the group consisting of: DNA, synthetic DNA, micro-identifier and dyes.

Further, the base body 100 and the cover body 200 may comprise a cooperating holding arrangement 160, 260 and a further cooperating holding arrangement 170, 260. The cooperating holding arrangements 160, 260 and 170, 260 will be further explained in relation to the cover body 200.

Figure 3A:
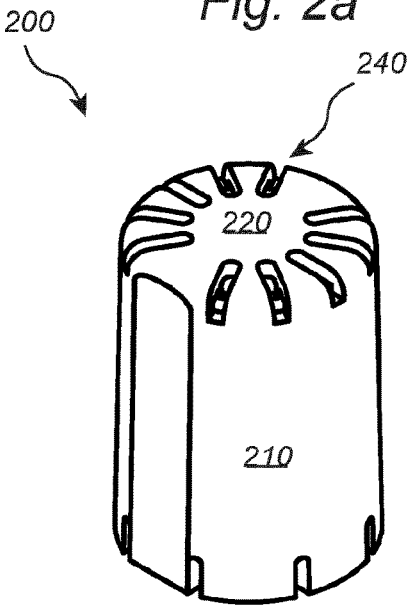
FIG. 3*a* conceptually illustrates a perspective side view of the cover body.
Figure 3B:
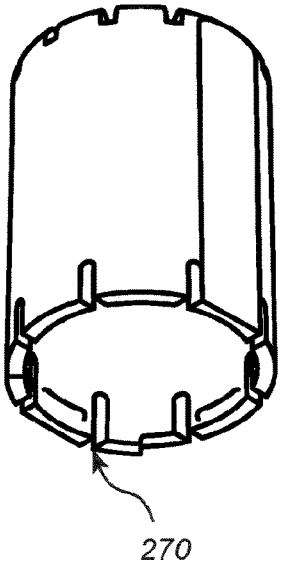
FIG. 3*b* conceptually illustrates a different perspective side view of the cover body of FIG. 3*a*.
Figure 3C:
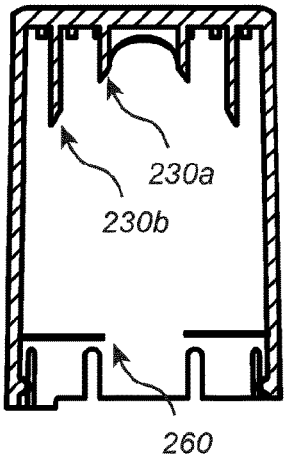
FIG. 3*c* conceptually illustrates a cross sectional view of the cover body of FIGS. 3*a* and 3*b*.

FIGS. 3*a* and 3*b* show different side views of the cover body 200. FIG. 3*c* shows a cross sectional view of the cover body 200. The cover body 200 is arranged or configured to be movably attached to the base body 100. The cover body 200 comprises a first surrounding portion 210, which is arranged to circumscribe a first portion 180 of the base body 100. Further the cover body 200 comprises a top portion 220 configured to be arranged above the film 190. The top portion 220 comprises a cutting device 230 configured to face the film 190. In the depicted cover body 200, a cutting device 230*a*, 230*b* in form of an inner rim of spikes 230*a* and an outer rim of spikes 230*b* is provided. The inner rim of spikes 230*a* is arranged to perforate the first compartment 120. The outer rim of spikes 230*b* is arranged to perforate the second compartment 130. Further, the top portion 220 comprises a release opening 240 extending through the top portion 220. In the depicted cover body 200 ten release openings 240 are provided in the top portion 220. Any number of release openings may be provided in the top portion 220, such as 2, 5, 8, 10, 50 or 100 to give a few non-limiting examples.

The first surrounding portion 210, when mounted to the base body 100, circumscribes or encloses the base body 100 such that the first surrounding portion 210 surrounds a first portion 180 of the base body 100. In other words, the first surrounding portion 210 of the cover body 200 surround a portion of a height of the base body 100, corresponding to the first portion 180 of the base body 100.

When mounted around and over the base body 100, the cover body 200 may be moved in relation to the base body 100. When moving the cover body 200 towards the base body 100 the cutting device 230 will perforate the film 190. By perforating the film 190, the safety liquid, such as a first constituent of liquid and a second constituent of liquid, is released through the release opening 240 or release openings 240. The cover body 200 may further comprise a cooperating holding arrangement 160, 260. The cooperating holding arrangement 260 and the cooperating holding arrangement 160 are configured to restrict movement of the cover body towards the film. The cooperating holding arrangement 260 may thus rest on the cooperating holding arrangement 160, such that only when a force is applied to the top portion 220 the cover body 200 may move towards the film 190. The cooperating holding arrangement 260 may then slide over the cooperating holding arrangement 160 when the force is applied to the top portion 220 the cover body 200. By cooperating holding arrangement 160, 260, the cutting device 230 may be hindered to perforate the film 190 before the user may wish for it to happen by applying a force to the top portion 220 the cover body 200. Moreover, the cooperating holding arrangement 260 may restrict movement of the cover body 200 away from the film 190 by cooperating with the cooperating holding arrangement 170. By this arrangement, the cover body 200 may not easily fall off the base body 100. Further, the cover body 200 may comprise cut outs 270. The cut outs 270 may provide flexibility to the bottom portion of the cover body 200, such that it may flex outwardly when force in applied to the top portion 220 such that the cooperating holding arrangement 260 may be pushed over the cooperating holding arrangement 160.

Figure 4:
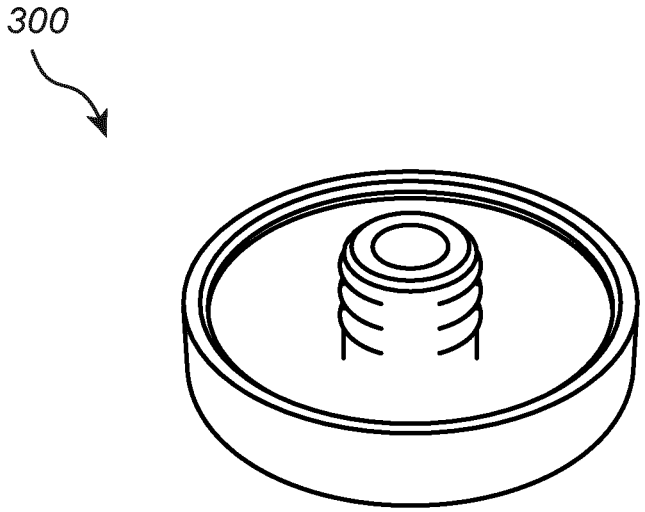
FIG. 4 conceptually illustrates a resealable lid.

FIG. 4 shows a resealable lid 300 which may be used to cover one end of the base body 100. The resealable lid 300 is adapted to fit with the second opening 150 of the base body 100. The resealable lid 300 may be removed by a user to open the second opening 150, enabling for the user to add an additive to the first constituent of liquid in the first compartment 120. The resealable lid 300 may then be attached to the base body 100 again.

Figure 5:
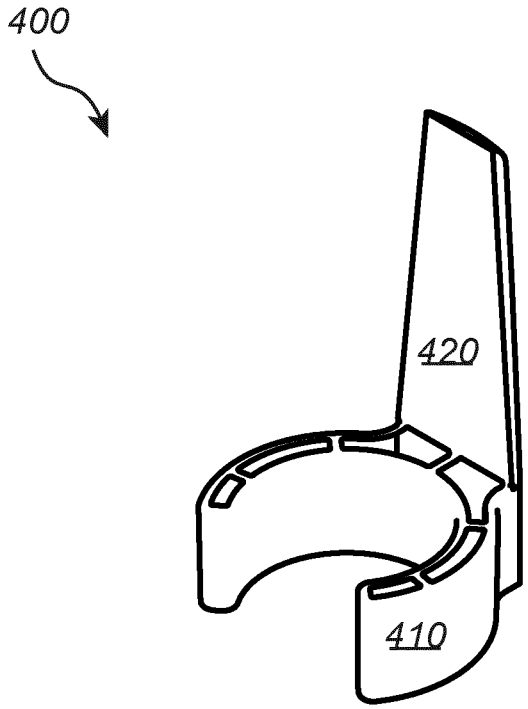
FIG. 5 conceptually illustrates a removable lock body.

FIG. 5 shows a removable lock body 400. The removable lock body 400 comprises a second surrounding portion 410 and a handle portion 420. The second surrounding portion 410 may at least partially circumscribe a second portion 185 of the base body. The lock body 400 may in this configuration hinder the cover body 200 from moving in relation to the base body 100, such that the cutting device 230 may be counteracted from being moved towards the film 190. The lock body 410 may easily be removed from the base body 100 by the user, enabling the cutting device 230 to perforate the film 190 upon application of force to the top portion 220 of the cover body 200. The handle portion 420 extends from the second surrounding portion 410 of the lock body 400. The handle portion 420 may be used as a handle to easily remove the lock body 400 from the base body 100. Further, the handle portion 420 may be used to attach the device 10 to for instance a bag, a waist band or any other suitable part of a user's clothes.

For example, a personal security device 10 is provided, wherein the device 10 comprises a base body 100 forming a chamber 110, wherein a first opening 140 of the chamber is sealed by a film 190, a safety liquid provided in the chamber 110 and a cover body 200 movably attached to the base body 100.

The cover body 200 comprises a first surrounding portion 210 circumscribing a first portion 180 of the base body 100 and a top portion 220 arranged above the film 190. The top portion 220 comprises a cutting device 230*a*, 230*b* facing the film 190 and a release opening 240 extending through the top portion 220. The cover body 200 is movable in relation to the base body 100 such that the cutting device 230*a*, 230*b* perforates the film 190 when the cover body 200 is moved towards the film 190 thereby releasing the safety liquid through the release opening 240.

The chamber 110 comprises a first compartment 120 and a second compartment 130. The safety liquid comprises a first constituent of liquid and a second constituent of liquid. The first constituent of liquid is provided in the first compartment 120 and the second constituent of liquid is provided in the second compartment 130. The first constituent comprises a DNA-stabilizing agent, being 10 mM Tris-HCl with a pH of 8.5 in combination with 1 mM EDTA. The second constituent comprises a marking substance, being an odor.

The base body 100 further comprises a second opening 150. The second opening 150 is provided with a resealable lid 300 such that the second opening 150 enables addition of a traceable additive to the first constituent. The traceable additive comprises DNA extracted from and by the user.

For example, a personal security device 10 is provided, wherein the device 10 comprises a base body 100 forming a chamber 110, wherein a first opening 140 of the chamber is sealed by a film 190, a safety liquid provided in the chamber and a cover body 200 movably attached to the base body 100.

The cover body 200 comprises a first surrounding portion 210 circumscribing a first portion 180 of the base body 100, and a top portion 220 arranged above the film 190. The top portion 220 comprises a cutting device 230*a*, 230*b* facing the film 190 and a release opening 240 extending through the top portion 220. The cover body 200 is movable in relation to the base body 100 such that the cutting device 230*a*, 230*b* perforates the film 190 when the cover body 200 is moved towards T the film 190 thereby releasing the safety liquid through the release opening 240.

The chamber 110 comprises a first compartment 120 and a second compartment 130. The safety liquid comprises a first constituent of liquid and a second constituent of liquid. The first constituent of liquid is provided in the first compartment 120 and the second constituent of liquid is provided in the second compartment 120. The first constituent comprises a DNA-stabilizing agent, being 10 mM Tris-HCl with a pH of 8.5 in combination with 1 mM EDTA-$Na_2$. The second constituent comprises a marking substance, being an odor chosen from the group consisting of: skatol, 3-methylindole, triethyl phosphite, butyric acid, benzylthiol, benzyl mercaptan, 2-mercaptoethanol, 1,2-Ethanedithiol, trimethylphosphite, cadaverin, pentamethylenediamine, 2-Mercaptophenol, o-mercaptophenol, thiophenol, tiophene-2-thiol, 3-Mercaptophenol, 3-Hydroxythiophenol and bis(trimethylsilyl)sulfide.

The base body further 100 comprises a second opening 150. The second opening 150 is provided with a resealable lid 300 such that the second opening 150 enables addition of a traceable additive to the first constituent. The traceable additive comprises DNA extracted from and by the user.

For example, a personal security device 10 is provided, wherein the device 10 comprises a base body 100 forming a chamber 110, wherein a first opening 140 of the chamber is sealed by a film 190, a safety liquid provided in the chamber 110 and a cover body 200 movably attached to the base body 100.

The cover body 200 comprises a first surrounding portion 210 circumscribing a first portion 180 of the base body 110 and a top portion 220 arranged above the film 190. The top portion 220 comprises a cutting device 230 facing the film 190 and a release opening 240 extending through the top portion 220. The cover body 200 is movable in relation to the base body 100 such that the cutting device 230 perforates the film 190 when the cover body 200 is moved towards T the film 190 thereby releasing the safety liquid through the release opening 240.

The chamber 110 comprises a single compartment, i.e. the single compartment is formed by the chamber 110. The safety liquid comprises a single constituent of liquid. The single constituent of liquid is provided in the single compartment of the chamber 110. The singe constituent of liquid comprises a marking substance, being an odor, a color or a fluorescent substance.

For example, a personal security device 10 is provided, wherein the device 10 comprises a base body 100 forming a chamber 110, wherein a first opening 140 of the chamber is sealed by a film 190, a safety liquid provided in the chamber 110 and a cover body 200 movably attached to the base body 100.

The cover body 200 comprises a first surrounding portion 210 circumscribing a first portion 180 of the base body 110 and a top portion 220 arranged above the film 190. The top portion 220 comprises a cutting device 230 facing the film 190 and a release opening 240 extending through the top portion 220. The cover body 200 is movable in relation to the base body 100 such that the cutting device 230 perforates the film 190 when the cover body 200 is moved towards T the film 190 thereby releasing the safety liquid through the release opening 240.

The chamber 110 comprises a single compartment, i.e. the single compartment is formed by the chamber 110. The safety liquid comprises a single constituent of liquid. The single constituent of liquid is provided in the single compartment of the chamber 110. The singe constituent of liquid comprises a marking substance, being an odor, a color or a fluorescent substance and a traceable additive being DNA, synthetic DNA, micro-identifier and dyes.

The invention claimed is:

1. A personal security device comprising:

a base body forming a chamber, wherein a first opening of the chamber is sealed by a film;

a safety liquid provided in the chamber; and a cover body movably attached to the base body, wherein the cover body comprises a first surrounding portion circumscribing a first portion of the base body, and a top portion arranged above the film, wherein the top portion comprises a cutting device facing the film, and a release opening extending through the top portion, wherein the cover body is configured to be moved in relation to the base body such that the cutting device perforates the film when the cover body is moved towards (T) the film thereby releasing the safety liquid through the release opening, wherein the chamber comprises a first compartment and a second compartment, wherein the safety liquid comprises a first constituent of liquid and a second constituent of liquid, wherein the first constituent of liquid is provided in the first compartment and the second constituent of liquid is provided in the second compartment, and wherein the device further comprises a removable lock body, wherein the lock body comprises a second surrounding portion at least partially circumscribing a second portion of the base body, and a handle portion extending from the second surrounding portion, wherein the lock body is configured such that the movement of the cover body towards the film is restricted.

2. The personal security device according to claim 1, wherein the second constituent of liquid comprises a marking substance.

3. The personal security device according to claim 2, wherein the marking substance is one or more chosen from the group consisting of: an odor, a color and a fluorescent substance.

4. The personal security device according to claim 2, wherein the marking substance comprises one or more substance chosen from the group consisting of: skatol, 3-methylindole, triethyl phosphite, butyric acid, benzylthiol, benzyl mercaptan, 2-mercaptoethanol, 1,2-Ethanedithiol, trimethylphosphite, cadaverin, pentamethylenediamine, 2-Mercaptophenol, o-mercaptophenol, thiophenol, tiophene-2-thiol, 3-Mercaptophenol, 3-Hydroxythiophenol and bis(trimethylsilyl)sulfide.

5. The personal security device according to claim 1, wherein the base body further comprises a second opening providing access to the first compartment, wherein the second opening is provided with a resealable lid such that the second opening enables addition of a traceable additive to the first constituent of liquid.

6. The personal security device according to claim 5, wherein the traceable additive comprises one or more chosen from the group consisting of: DNA, synthetic DNA and micro-identifier.

7. The personal security device according to claim 1, wherein the first constituent of liquid comprises a traceable substance.

8. The personal security device according to claim 7, wherein the traceable substance is one or more chosen from the group consisting of: DNA, synthetic DNA, micro-identifier and dyes.

9. The personal security device according to claim 1, wherein the base body and the cover body further comprise a cooperating holding arrangement configured to restrict movement of the cover body towards the film, wherein the holding arrangement is releasably engageable.

10. The personal security device according to claim 1, wherein the base body and the cover body further comprise a further cooperating holding arrangement configured to restrict movement of the cover body away from the film.

11. The personal security device according to claim 1, wherein the first constituent of liquid comprises a DNA-stabilizing agent.

12. The personal security device according to claim 11, wherein the DNA-stabilizing agent is chosen from the group consisting of Tris-HCl in combination with EDTA and Tris-HCl in combination with EDTA-$Na_2$.

* * * * *